US009235995B2

(12) United States Patent
Czapar

(10) Patent No.: US 9,235,995 B2
(45) Date of Patent: Jan. 12, 2016

(54) PANEL COMMUNICATION VIA ILLUMINATED BEZEL

(75) Inventor: Matthew Czapar, Milwaukee, WI (US)

(73) Assignee: Eaton Corporation, Cleveland, OH (US)

( * ) Notice: Subject to any disclaimer, the term of this patent is extended or adjusted under 35 U.S.C. 154(b) by 87 days.

(21) Appl. No.: 13/340,835

(22) Filed: Dec. 30, 2011

(65) Prior Publication Data

US 2013/0169435 A1 Jul. 4, 2013

(51) Int. Cl.

| | |
|---|---|
| ***G08B 21/00*** | (2006.01) |
| ***G09F 9/30*** | (2006.01) |
| ***G09F 9/35*** | (2006.01) |
| ***G09F 27/00*** | (2006.01) |
| ***G09F 13/00*** | (2006.01) |
| *G09F 13/18* | (2006.01) |
| *G09F 13/22* | (2006.01) |

(52) U.S. Cl.

CPC .. *G09F 9/30* (2013.01); *G09F 9/35* (2013.01); *G09F 13/005* (2013.01); *G09F 27/00* (2013.01); *G09F 2013/1872* (2013.01); *G09F 2013/1881* (2013.01); *G09F 2013/222* (2013.01)

(58) Field of Classification Search

CPC ..... G01J 1/02; G01J 1/0219; G01J 1/0228; G01J 1/0247; G01J 1/16; G01J 1/32; G01J 1/44; H05B 37/0218; H05B 37/02; Y02B 20/46; A47F 1/04; A47F 3/002; G07F 17/3202; G07F 17/3211; G06F 1/18

USPC ..... 340/540, 539.22, 539.26, 539.23, 340/539.19, 539.1, 555, 641, 653, 691.6, 340/686.2, 686.5, 825.23, 5.23

See application file for complete search history.

(56) References Cited

U.S. PATENT DOCUMENTS

| | | | | |
|---|---|---|---|---|
| 5,395,074 | A * | 3/1995 | Hart et al. | 244/118.1 |
| 5,896,348 | A * | 4/1999 | Lyon | 368/223 |
| 7,091,964 | B2 * | 8/2006 | Wong et al. | 345/184 |
| 7,166,930 | B2 * | 1/2007 | Young | 307/64 |
| 7,632,079 | B2 * | 12/2009 | Hershberger et al. | 417/477.2 |
| 8,456,104 | B2 * | 6/2013 | Allard et al. | 315/294 |
| 2002/0118182 | A1 * | 8/2002 | Weindorf | 345/204 |
| 2004/0053663 | A1 * | 3/2004 | Paulsen et al. | 463/16 |
| 2009/0289874 | A1 | 11/2009 | Ha | |

(Continued)

OTHER PUBLICATIONS

Written Opinion from the Authorized Searching Authority (corresponding to Application: PCT/US2012/072059) European Patent Office; Authorized Officer Bauer, Jeanne; Issued Mar. 19, 2013 (5 pages).

(Continued)

*Primary Examiner* — Daniel Previl

(74) *Attorney, Agent, or Firm* — Benesch, Friedlander, Coplan & Aronoff, LLP

(57) ABSTRACT

A system for communicating status information associated with a device has an interface panel. The interface panel has a bezel extending substantially around a perimeter thereof. The interface panel is configured to interface with the device. The interface panel has a light device disposed substantially around a perimeter of the bezel. The light device is configured to illuminate the bezel. The system has a light controller coupled to the light device. The light controller is configured to control light output of the light device to indicate a status of the device.

19 Claims, 4 Drawing Sheets

(56) References Cited

U.S. PATENT DOCUMENTS

| | | | | |
|---|---|---|---|---|
| 2011/0018462 | A1 | 1/2011 | Lowe et al. | |
| 2011/0018849 | A1 | 1/2011 | Lowe et al. | |
| 2011/0051019 | A1* | 3/2011 | Hardacker et al. | 348/739 |
| 2013/0003405 | A1* | 1/2013 | Fehn et al. | 362/551 |

OTHER PUBLICATIONS

International Search Report of the Authorized Searching Authority (corresponding to Application: PCT/US2012/072059) European Patent Office; Authorized Officer Bauer, Jeanne; Issued Apr. 18, 2013 (5 pages).

* cited by examiner

PANEL COMMUNICATION VIA ILLUMINATED BEZEL

FIELD OF INVENTION

The present invention relates to interface panels and more particularly to communicating status information associated with a device via an illuminated bezel of an interface panel.

BACKGROUND

Interface panels are used in a variety of industries and applications for controlling various mechanical devices and software applications. Interface panels have buttons and other types of controls for receiving input from a user as well as LEDs for conveying information to a user. In certain applications, such as in an industrial power application, interface panels may be combined to form a larger control center.

The LEDs consume valuable space on the interface panel, however, which could be otherwise used for additional interface buttons and other types of controls. In addition, in applications where several interface panels are combined to form a larger control center, it may be difficult to distinguish a message being communicated via a first interface panel from a message being communicated via a second interface panel.

SUMMARY OF THE INVENTION

In a system for communicating status information associated with a device, an interface panel has a bezel extending substantially around a perimeter thereof. The interface panel is configured to interface with the device. The interface panel has a light device disposed substantially around a perimeter of the bezel. The light device is configured to illuminate the bezel. The system has a light controller coupled to the light device. The light controller is configured to control light output of the light device to indicate a status of the device In an interface panel for communicating a status of a device, a bezel extends substantially around a perimeter of the interface panel. A light device is disposed substantially around a perimeter of the bezel. The light device is configured to illuminate the bezel. A light controller is coupled to the light device. The light controller is configured to control light output of the device to indicate a status of the device.

In a method for communicating status information associated with a device, a computer receives a notification to communicate a status of the device. The computer determines at least one parameter, based on the status, for illuminating a light device disposed substantially around a perimeter of an interface panel. The computer controls a light output of the light device, according to the at least one parameter, to indicate a status of the device.

BRIEF DESCRIPTION OF THE DRAWINGS

In the accompanying drawings, structures are illustrated that, together with the detailed description provided below, describe exemplary embodiments of the claimed invention. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Figure 1:
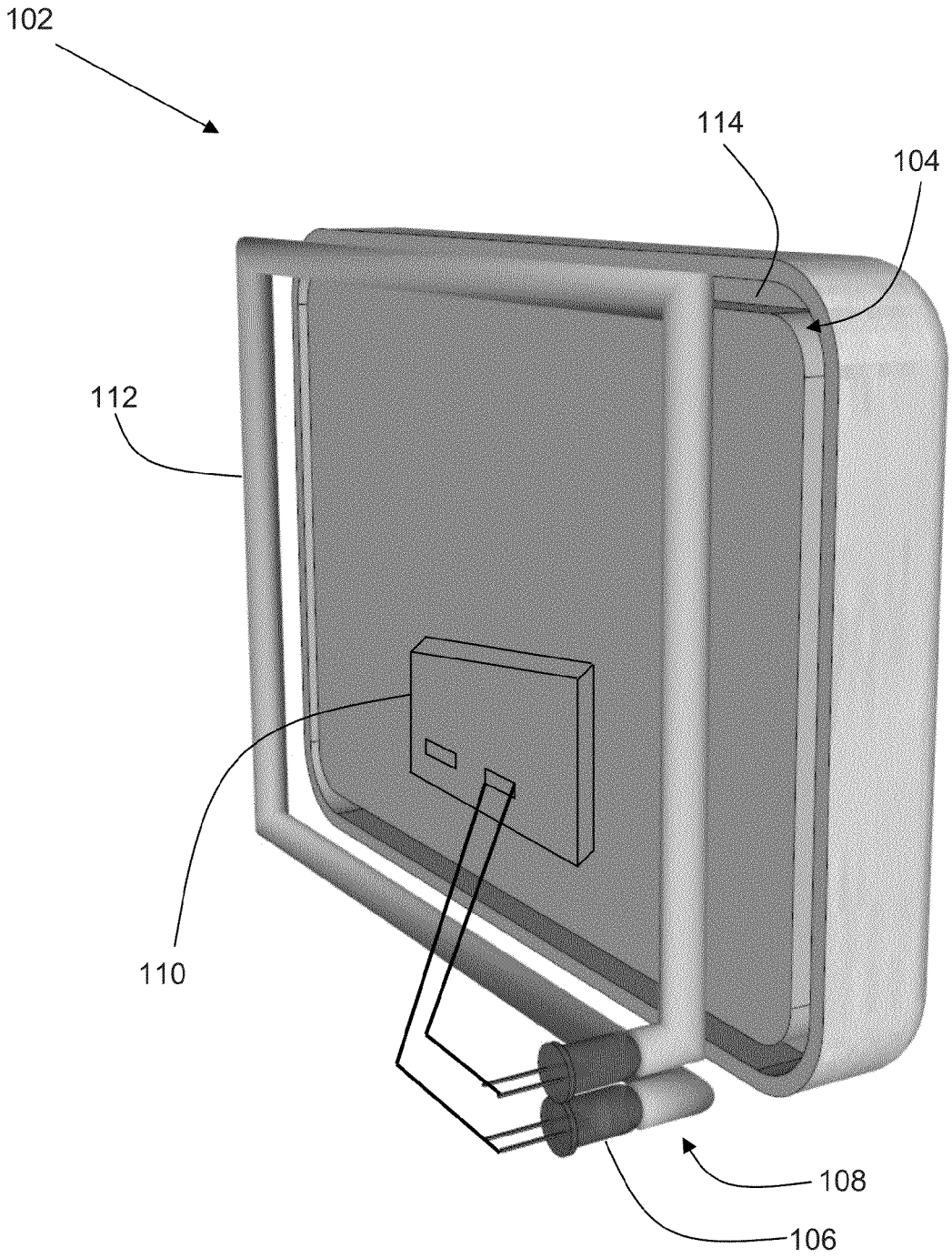
FIG. 1 is a rear perspective view of an example system, according to one embodiment of the present invention.

FIG. 1 is a rear perspective view of an example interface panel 102 according to one embodiment of the present invention. Interface panel 102 enables a user to control a software application or a mechanical device. For example, interface panel 102 may be used in an industrial setting for controlling an industrial motor. In an example embodiment, multiple interface panels 102 may be combined to form a larger control panel for controlling one or more software applications or mechanical devices. Interface panel 102 may include various types of buttons and switches and other controls for receiving input from a user. In addition, the interface panel 102 may include LEDs and other types of light displays for communicating messages to the user, on the front face (not shown) of interface panel 102.

Interface panel 102 has a bezel 104 extending substantially around the perimeter of interface panel 102. Bezel 104 has a channel 114 or a groove configured in size and shape so as to receive light device 108 which extends substantially around the perimeter of interface panel 102. In an alternative embodiment (not shown), bezel 104 and light device 108 may extend around a substantial portion of interface panel 102. For example, bezel 104 and light device 108 may extend across the top of interface panel 102 and along each side of interface panel 102. After channel 114 receives light device 108 during assembly, light device 108 becomes integrated with interface panel 102. Light device 108 may be secured in place within bezel 104 by an adhesive, for example. Alternatively, light device 108 may be secured in place within bezel 104 mechanically, such as through an interference fit.

Light device 108 is configured to transport the light around the perimeter of interface panel 102, throughout the length of light device 108. In an example embodiment, light device 108 is configured in such a way that as the light is being transported around interface panel 102, the light is being evenly distributed throughout light device 108 in order to evenly illuminate the perimeter of interface panel 102.

In an example embodiment, light device 108 comprises a light source 106 configured to generate the light and a light tube 112 coupled to light source 106 and configured to distribute the light. Light source 106 can be an LED, or a plurality of LEDs, for example. In an example embodiment, light source 106 is configured to deliver a single color of light. In an example embodiment, light source 106 is configured to deliver multiple colors of light, either simultaneously or independently.

In an example embodiment, light device 108 comprises a rectangular-shaped fluorescent light. It should be understood that, although light device 108 has been described with reference to various example embodiments, light device may comprise other similar embodiments capable of illuminating bezel 104.

Interface controller 102 also includes a light controller 110 that is coupled to light device 108. Light controller 110 is configured to control light device 108 to indicate a status of the mechanical device. In other words, a user is able to interpret a light output being delivered around the perimeter of interface panel 102 to be a status of a mechanical device. Light controller 110 is configurable to control light device 108 according to a user defined preference.

In an example embodiment, light controller 110 is configured to control light device 108 to generate a first color light to indicate a first status of a mechanical device and a second color light to indicate a second status of the mechanical device. For example, light controller 110 may control light device 108 to generate a green color light to indicate that an associated mechanical device is operating properly. Similarly, light controller 110 may control light device 108 to generate a red color light to indicate that the associated mechanical device is operating in an error or fault state and that the associated mechanical device may need to be serviced or may require other operator attention. It should be understood that, although light controller 110 has been described as being configured to control light device 108 to generate two different colors of light to indicate two different statuses of an associated mechanical device, light controller 110 may also be configured to control light device to generate three of more different colors of light to indicate three or more statuses of the associated mechanical device.

In an example embodiment, light controller 110 may be configured to set light device 108 to flash on and off repeatedly rather then generating a continuous light. In an example embodiment, light controller 110 may be configured to control the frequency at which light device 108 flashes. In other words, light controller 110 may control light device 108 to flash at a first frequency to indicate a first status of a mechanical device and to flash at a second frequency to indicate a second status of the mechanical device. For example, light controller 110 may control light device 108 to flash at 60 Hz when an associated mechanical device has a potential problem that may require future attention while light controller 110 may control light device 106 to flash at 120 Hz when an associated mechanical device has a severe problem that may require immediate attention.

In an example embodiment, light controller 110 may be configured to control light device 108 in order to accommodate various international standards. For example, a flashing color may indicate a first status according to a first country's standard, while the same flashing color may indicate a second status according to a second country's standard. Thus, depending on which country light controller 110 is configured to operate in, light controller 110 may adjust the light color generated by light device 108 for a given message.

In an example embodiment, light controller 110 may be configurable by a user or a systems administrator to control light device 108 according to user defined parameters. For example, a user may define a certain color scheme which that user prefers. Accordingly, light controller 110 may be configured to control light device 108 according to the user's preferences.

It an example embodiment, light controller 110 can be implemented as a microcontroller or other similar computing device embedded in interface panel 102. In such an embodiment, a user or a systems administrator may configure light controller 110 by interfacing with light controller 110 via an external computing device such as a personal computer. An external computer may interface with light controller 110 via a USB port, or other similar type of interface port. Alternatively, an external computer may interface with light controller 110 via a wireless protocol such as radio frequency or 802.11, for example.

In an example embodiment, light controller 110 may be external (not shown) to interface panel 102. For example, light controller 110 may be a desktop computer, a laptop computer, a handheld computer, a tablet computer, a server, or other similar type of computing device capable of providing instructions to, and controlling, light device 108. In such an embodiment, a user or a systems administrator may configure light controller 110 by interacting with light controller 110 directly, via user interface peripherals such a keyboard, mouse, or touch screen.

Figure 2:
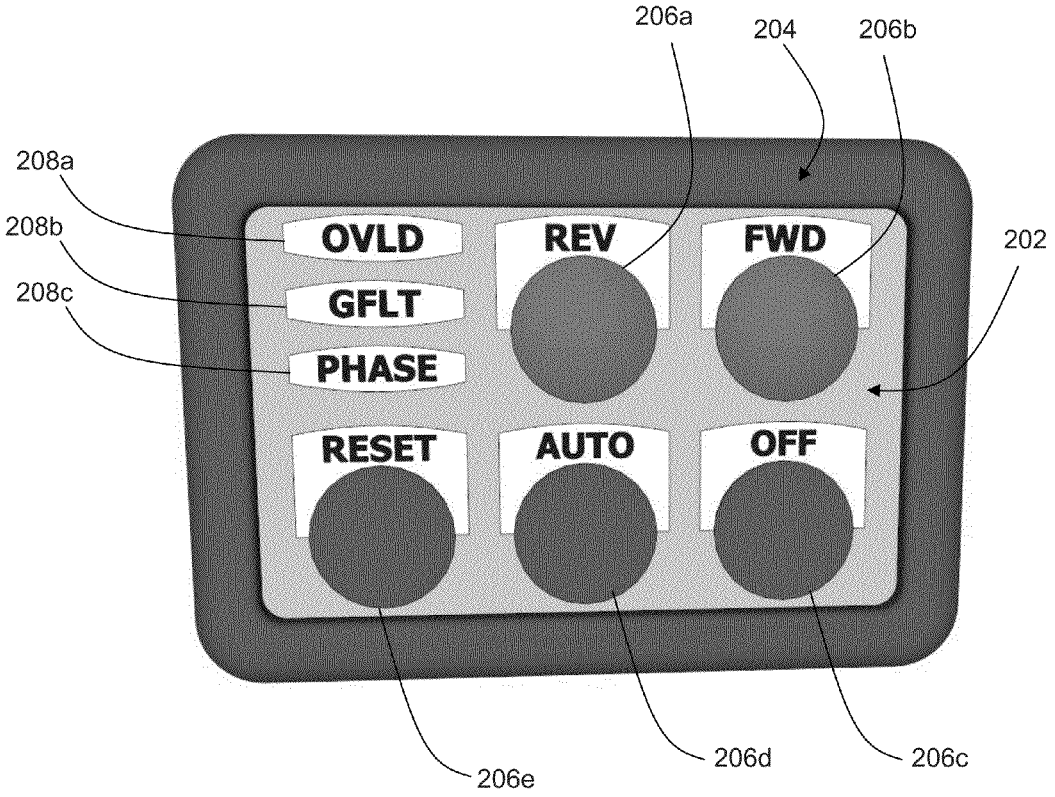
FIG. 2 is a front view of an example interface panel, according to one embodiment of the present invention.

FIG. 2 is a front view of an example interface panel 202 having a light device 204 substantially surrounding the perimeter of interface panel 202. Interface panel 202 has a plurality of buttons 206*a-e* for controlling various functions of an associated mechanical device or software application. Interface panel 202 also has a plurality of LEDs 208*a-c* for communicating information to a user. It should be understood that, although interface panel 202 has been described as having a specific number of buttons and LEDs, interface panel 202 may have any number and combination of buttons and LEDs. For example, interface panel 202 may comprise only buttons. In another example, interface panel 202 may comprise switches and other similar types of controls for controlling an associated mechanical device or software application.

Figure 3:
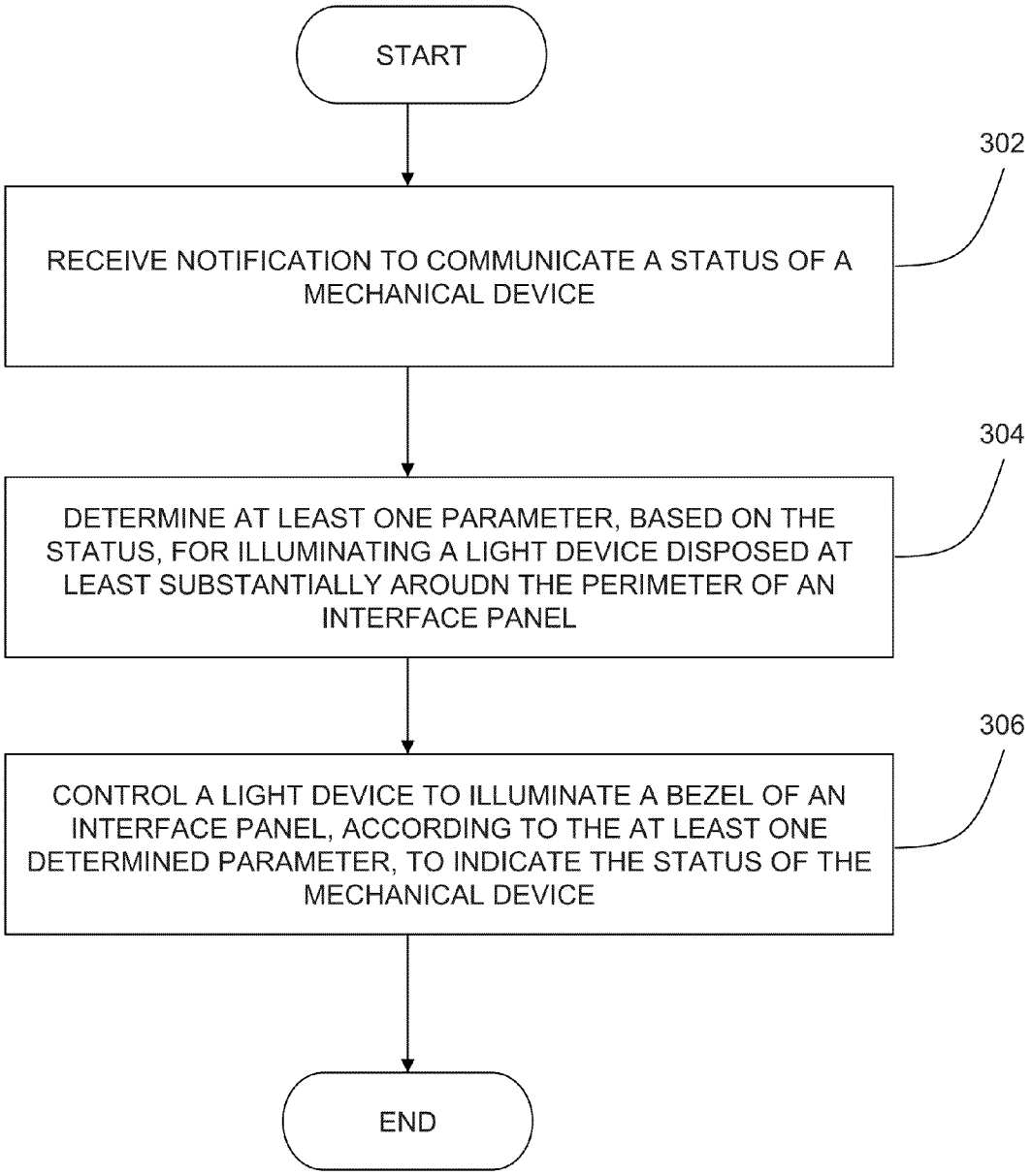
FIG. 3 is a flow chart illustrating an example method for communicating status information associated with a device via an illuminated bezel of a panel, according to one embodiment of the present invention.

FIG. 3 is a flow chart illustrating an example method for communicating status information associated with a device via an illuminated bezel of a panel. At step 302, light controller 110 receives a notification to communicate a status. The notification may come from an associated mechanical device or it may come from a software application or system. The notification may be an error or some other type of warning. Alternatively, the notification may be sent to simply inform a user of a current status or condition of a mechanical device.

At step 304, light controller 110 determines at least one parameter, based on the status, for illuminating light device 108 disposed at least substantially around the perimeter of interface panel 102. In an example embodiment, light controller 110 may determine multiple parameters for generating the light. Parameters for generating a light may include a color, a flash frequency, or another similar type of parameter for defining how light device 108 is illuminated. Light controller 110 may determine the parameter(s) by cross referencing the received status notification with a parameters database (not shown) stored in light controller's 110 internal memory. A status to be communicated may be pre-associated with specific parameters in a parameters database based on user preference or based on country specific standards, for example. For example, an error message may be pre-associated with the color red and with a flash frequency of 120 Hz in the parameters database, while a maintenance warning message may be associated with the color yellow and with a flash frequency of 60 Hz in the parameters database. Thus, light controller 110 may be configured to control light device 108 to operate according to a user preference by configuring the parameters database.

At step 306, light controller 110 controls light device 108 to illuminate bezel 104 of interface panel 102, according to the at least one determine parameter, to indicate the status of the mechanical device.

Figure 4:
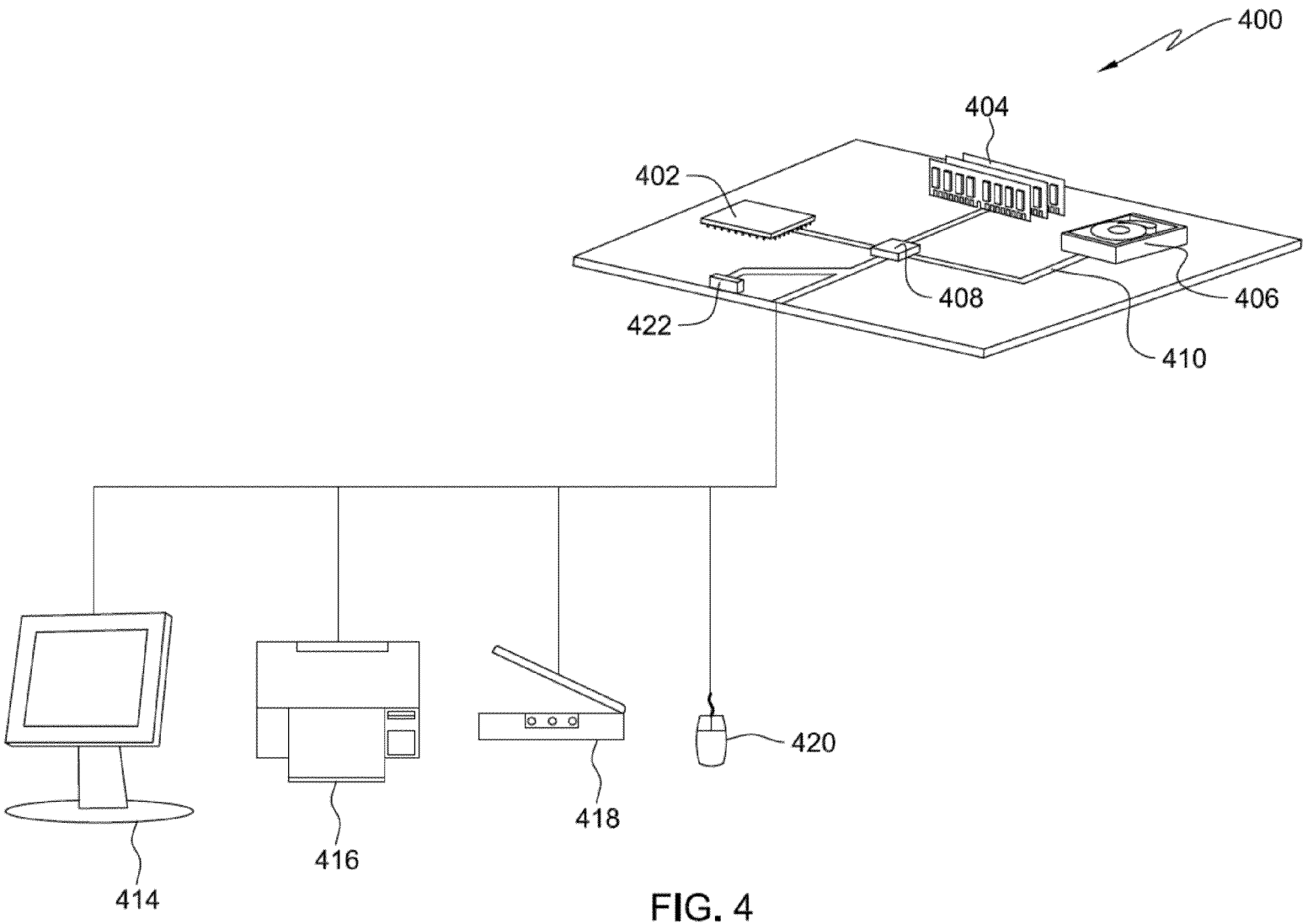
FIG. 4 is a block diagram of an example computer system for implementing the functionality of a light controller, according to one embodiment of the present invention.

FIG. 4 is a block diagram of an example computer system 400 for implementing the functionality of light controller 110. Computer system 400 is intended to represent various forms of digital computers, including laptops, desktops, handheld computers, tablet computers, servers, and other similar types of computing devices. Computer system 400 includes a processor 402, memory 404, a storage device 406, and a communication port 422, connected by an interface 408 via a bus 410.

Processor 402 processes instructions, via memory 404, for execution within computer system 400. In an example embodiment, multiple processors along with multiple memories may be used. In an example embodiment, multiple computer systems 400 may be connected, with each device providing portions of the necessary operations.

Memory 404 may be volatile memory or non-volatile memory. Memory 404 may be a computer-readable medium, such as a magnetic disk or optical disk. Storage device 406 may be a computer-readable medium, such as floppy disk devices, a hard disk device, and optical disk device, a tape device, a flash memory, or other similar solid state memory device, or an array of devices, including devices in a storage area network of other configurations. A computer program product can be tangibly embodied in a computer readable medium such as memory 404 or storage device 406.

Computer system 400 can be coupled to one or more input and output devices such as a display 414, a scanner 418, a printer 416, and a mouse 420.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

Some portions of the detailed descriptions are presented in terms of algorithms and symbolic representations of operations on data bits within a memory. These algorithmic descriptions and representations are the means used by those skilled in the art to convey the substance of their work to others. An algorithm is here, and generally, conceived to be a sequence of operations that produce a result. The operations may include physical manipulations of physical quantities. Usually, though not necessarily, the physical quantities take the form of electrical or magnetic signals capable of being stored, transferred, combined, compared, and otherwise manipulated in a logic and the like.

It has proven convenient at times, principally for reasons of common usage, to refer to these signals as bits, values, elements, symbols, characters, terms, numbers, or the like. It should be borne in mind, however, that these and similar terms are to be associated with the appropriate physical quantities and are merely convenient labels applied to these quantities. Unless specifically stated otherwise, it is appreciated that throughout the description, terms like processing, computing, calculating, determining, displaying, or the like, refer to actions and processes of a computer system, logic, processor, or similar electronic device that manipulates and transforms data represented as physical (electronic) quantities.

While the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the application, in its broader aspects, is not limited to the specific details, the representative apparatus and method, and illustrative examples shown and described. Accordingly, departures may be made from such details without departing from the spirit or scope of the applicant's general inventive concept.

What is claimed is:

1. A system for communicating status information, the system comprising:

a mechanical device;

an interface panel having a bezel extending substantially around a perimeter thereof and a control that controls a function of the mechanical device;

a light device disposed substantially around a perimeter of the interface panel, the light device configured to illuminate the bezel; and a light controller coupled to the light device, the light controller configured to receive a notification indicative of an error or fault state of the mechanical device and to control light output of the light device to indicate the error or fault state of the mechanical device.

2. The system of claim 1, wherein the light output of the light device comprises at least one of a color of light and a light flash frequency.

3. The system of claim 2, wherein the light controller is further configured to control the light device to generate a first color light to indicate a first status of the mechanical device and a second color light to indicate a second status of the mechanical device.

4. The system of claim 2, wherein the light controller is further configured to control the light device to flash the light at a first frequency to indicate a first status of the mechanical device and to flash the light at a second frequency to indicate a second status of the mechanical device.

5. The system of claim 1, wherein the light device comprises:

a light source configured to generate the light; and a light tube coupled to the light source and configured to distribute the light.

6. The system of claim 5, wherein the light source comprises at least one LED.

7. The system of claim 1, wherein the light controller is configurable to control the light device according to a user defined preference.

8. The system of claim 1, wherein the mechanical device is an industrial motor.

9. An interface panel comprising:

a bezel extending substantially around a perimeter of the interface panel;

a light device disposed substantially around a perimeter of the interface panel and configured to generate a light;

a control that controls a function of a mechanical device; and a light controller coupled to the light device and configured to receive a notification indicative of a an error or fault state of the mechanical device and to control the light output of the light device to indicate the error or fault state of the mechanical device.

10. The interface panel of claim 9, wherein the light output of the light device comprises at least one of a color of light and a light flash frequency.

11. The interface panel of claim 10, wherein the light controller is further configured to control the light device to generate a first color light to indicate a first status of the mechanical device and a second color light to indicate a second status of the mechanical device.

12. The interface panel of claim 10, wherein the light controller is further configured to control the light device to flash the light at a first frequency to indicate a first status of the mechanical device and to flash the light at a second frequency to indicate a second status of the mechanical device.

13. The interface panel of claim 9, wherein the light device comprises:

a light source configured to generate the light; and a light tube coupled to the light source, and configured to distribute the light.

14. The interface panel of claim 13, wherein the light source comprises at least one LED.

15. The interface panel of claim 9, wherein the light controller is configurable to control the light device according to a user defined preference.

16. The interface panel of claim 9, wherein the mechanical device is an industrial motor.

17. A method for communicating status information, the method comprising the steps of:

a computer receiving a notification to communicate an error of fault state of a mechanical device;

the computer determining at least one parameter, based on the error or fault state, for illuminating a light device disposed substantially around a perimeter of an interface panel, wherein the interface panel comprises a control that controls a function of the mechanical device; and the computer controlling a light output of the light device, according to the at least one parameter, to indicate the error or fault state of the mechanical device.

18. The method of claim 17, wherein the at least one parameter is color.

19. The method of claim 17, wherein the at least one parameter is flash frequency.

* * * * *